United States Patent [19]

Hawkrigg

[11] Patent Number: 4,794,660

[45] Date of Patent: Jan. 3, 1989

[54] SHEET ANCHORING DEVICE

[76] Inventor: William G. Hawkrigg, 47395 Monroe St. #140, Indio, Calif. 93302

[21] Appl. No.: 120,386

[22] Filed: Nov. 13, 1987

[51] Int. Cl.[4] ..... A47C 21/02

[52] U.S. Cl. ..... 5/498; 24/72.5

[58] Field of Search ..... 5/496, 498; 24/72.5; 135/119

[56] References Cited

U.S. PATENT DOCUMENTS

| | | | |
|---|---|---|---|
| 2,507,091 | 5/1950 | Carlson | 24/72.5 |
| 3,656,212 | 4/1972 | Velte | 135/119 X |
| 4,400,836 | 8/1983 | Pelura | 24/72.5 X |
| 4,624,022 | 11/1986 | Dolan | 24/72.5 X |
| 4,635,308 | 1/1987 | Maggio et al. | 24/72.5 X |

FOREIGN PATENT DOCUMENTS

| | | | |
|---|---|---|---|
| 2228156 | 12/1973 | Fed. Rep. of Germany | 24/72.5 |

*Primary Examiner*—Gary L. Smith
*Assistant Examiner*—Michael F. Trettel
*Attorney, Agent, or Firm*—I. Louis Wolk

[57] ABSTRACT

A retaining device for sheet materials such as bed sheets, etc. which comprises a pair of flat panels hinged together to form an elongated member with a pair of sections foldable over each other, one of said sections having a slot formed therein to receive corner or other portions of said sheet materials to be threaded therethrough and the other of said segments having a lip portion for engagement with said threaded sheet portions whereby said threaded portion is clamped therebetween. Said device is designed to be positioned beneath a bed mattress or other cushioning means to retain said segments in clamping position with respect to said corner or threaded portion.

9 Claims, 2 Drawing Sheets

SHEET ANCHORING DEVICE

BACKGROUND OF THE INVENTION

This invention relates to a device for retaining the corners of a bed sheet, blanket or other covering under the corners of a mattress. It is also useful for retaining other sheet-like products such as tarpaulins, tents, etc. A problem which occurs frequently with such bed coverings is that they become dislodged during use, which problem is especially the case with waterbed type mattresses, due no doubt to the vibration or similar movements which occur during use.

Various attempts have been made to solve this problem but even the use of sheets designed to be fitted over mattress corners has not been fully satisfactory, especially in the case of waterbed mattresses. Certain mechanical retainers have been utilized such as shown in U.S. Pat. Nos. 4,400,836, 4,520,518 or 4,521,970. These devices have certain disadvantages in that they either require the use of clips or buttons affixed to retainers to be inserted under the mattress or in the case of U.S. Pat. No. 4,400,836, require the insertion of the corner of the sheet through a series of slots which in the construction described will still permit the corner to be withdrawn from the device under tension or vibration.

SUMMARY OF THE INVENTION

In accordance with the present invention applicant has designed a retaining means which is adaptable for retaining the corners of either fitted or non-fitted sheets under mattresses or furniture cushions and the like of any type whether waterbed mattress or regular mattresses, etc., in a manner which provides positive locking of the corners without the necessity of incorporating mechanical devices such as clips or by the use of buttons, etc. This is accomplished by means of a flat panel member foldable to engage a corner of the sheet which is inserted through a slot in one portion thereof in such manner that the inserted portion is locked into position by clamping between the folds of said member.

This result is achieved by providing a flat elongated sheet member of rigid or semi-rigid material which is hinged or foldable along a transverse crease. Near one end of the member is a slot of suitable shape and dimensions to receive a corner of a sheet, whether fitted or otherwise. This end of the member is shaped and dimensioned to allow the corner of a fitted sheet to slip over said end or in the case of a non-fitted sheet to allow the corner to be knotted to define a pocket which can then be slipped over the end of the slotted portions of the member. Thereafter, the remaining hinged, non-slotted portion of this member is folded over to engage and clamp the sheet corner between the two portions.

The device can then be inserted underneath the mattress at the corner between it and the base or foundation member with the folded portions of the member compressed under the mattress to provide a positive locking action upon the corner of the sheet. By utilizing this device for all four corners of the mattress it has been found that highly satisfactory results in eliminating or minimizing loosening can be obtained.

DETAILED DESCRIPTION

Figure 1:
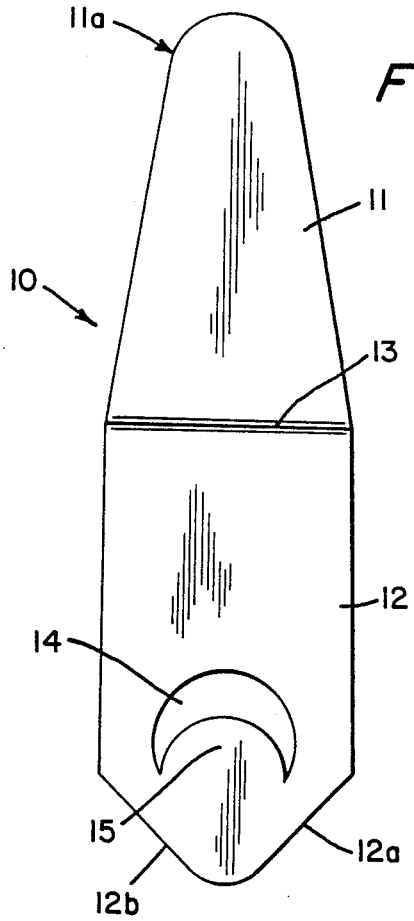
FIG. 1 is a perspective view of the device in open position.
Figure 2:
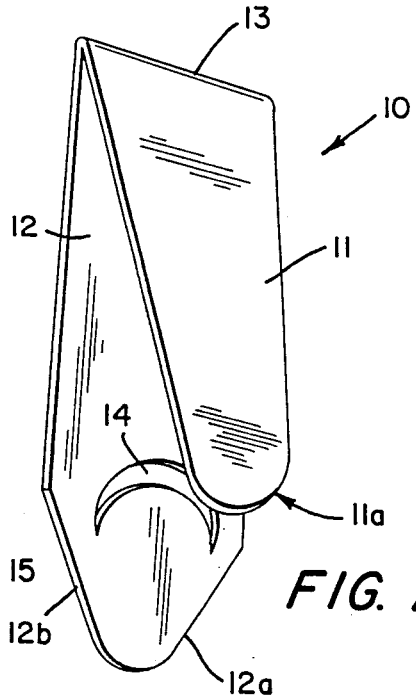
FIG. 2 is a perspective view of the device in partially folded or closed position.

The device of the invention is shown in FIGS. 1 and 2 as a flat rigid or semi-rigid thin, elongated member which is foldable transversely centrally thereof along a crease or preformed fold line or hinge, 13. One segment 11 is preferably formed with a curved or contoured lip 11*a*. The other segment 12 is formed with an angular end portion which is formed by edges 12*a* and 12*b* extending at right angles to permit the end portion to fit into a right angled corner such as that of a waterbed mattress enclosure. This segment is also provided with a slot 14 formed near the end. This slot may be of any desired shape or dimension so long as it is adequate to snugly receive the corners of fitted and conventional sheets or other coverings with which it is to be used. As shown the slot is arcuate and forms a second lip 15.

Figure 3:
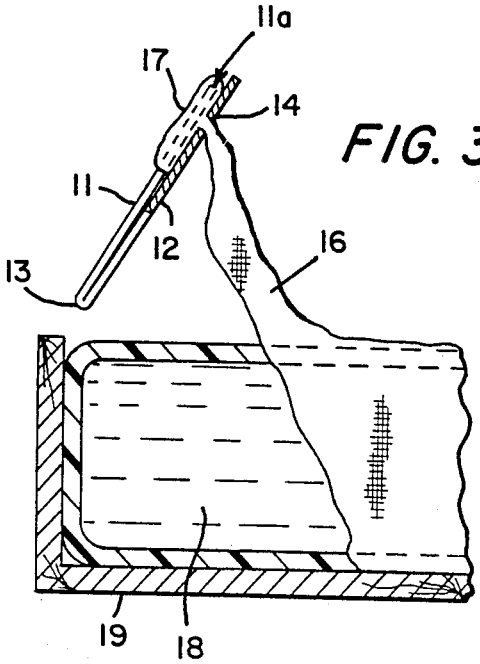
FIG. 3 is a view of the device in partial cross section prepared for anchoring a fitted sheet corner to a waterbed mattress.
Figure 4:
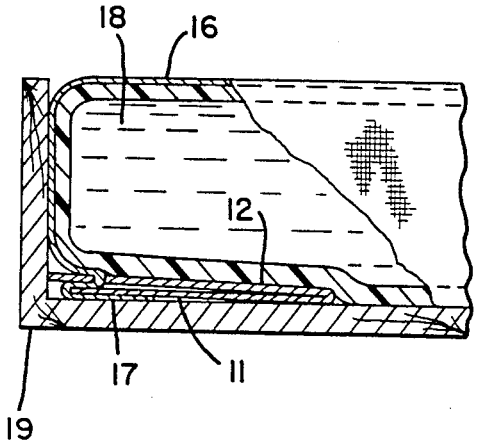
FIG. 4 is a view corresponding to FIG. 3 with the sheet corner in anchored position.

As shown in FIGS. 3 and 4, a sheet is shown as it is installed on a waterbed. Sheet 16 is spread on bed mattress 18 without inserting the corners. Each corner is installed in the manner described below. The fitted corner 17 of the sheet is turned inside out. The device 10 is then closed with the segments folded over each other (see FIGS. 2 and 3) and positioned flat upon the sheet in alignment from the corner toward the center of the bed. The device may be positioned so that the hinge position is toward the corner. The former positioning maybe preferable as it permits a greater degree of tightening of the sheet when the device is inserted beneath the mattress.

Figure 5:
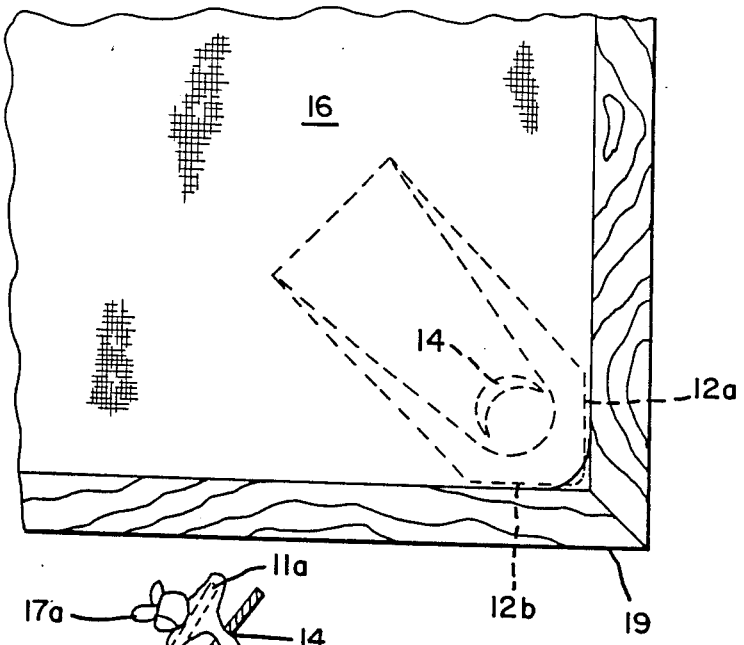
FIG. 5 is a top view showing the device positioned as in FIG. 4 at the corners of a waterbed mattress enclosure.

The corner of the sheet with the seam edge in the center is then threaded through slot 14 from underneath and towards lip 11*a*. The seam edge is then draped, still inside out, over the lip as shown in FIG. 3, pulling the corner tightly over the lip. The corner of the mattress is then lifted and pulled upward toward the center of the bed with one hand, With the other hand, while compressing the two segments of the device together against the retained corner of the sheet, the device is placed beneath the mattress (FIG. 4) with the corners 12*a* and 12*b* in engagement with the corners of the bed enclosure 19 as shown in FIG. 5. The fitted corner of the sheet can turn rightside out while this is being done. This procedure may then be repeated for the other three corners.

Figure 6:
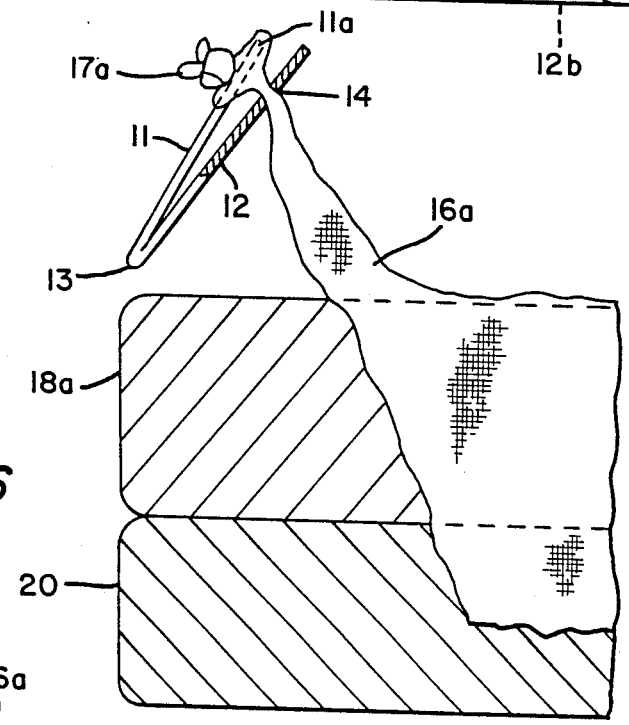
FIG. 6 is a view in elevation showing a conventional sheet positioned on the device preparatory to insertion; between a mattress and foundation.
Figure 7:
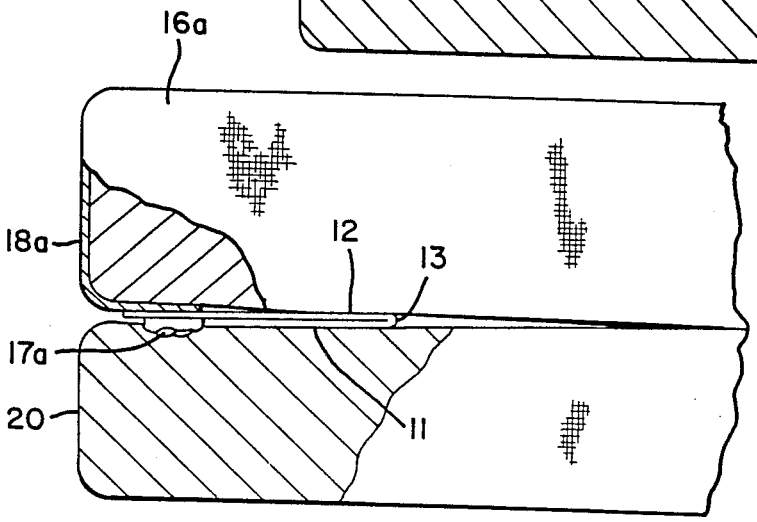
FIG. 7 is a view corresponding to FIG. 6 with the sheet anchored beneath the mattress.

Using regular bed sheets the same procedure may be followed except that to ensure anchoring of the corners the procedure illustrated in FIGS. 6 and 7 is followed. After the corner of sheet 16*a* is threaded through slot 14 a simple overhand knot 17*a* is tied leaving 2 inches or so at the end. The canopy formed by the knot is then draped over lip 11*a* with the knot facing upward as shown in FIG. 6. The device with the knot 17*a* clamped between segments 11 and 12 is then positioned beneath the corner of mattress 18*a* and retained between it and foundation 20 as shown in FIG. 7.

The device described herein may be formed of various types of sheet material ranging from cardboard, wood, laminated sheet materials, sheet plastic or sheet metals. The material can be of any suitable dimensions for given applications and may be of rigid or semi rigid stock. For general use for anchoring bed sheets typical overall dimensions can be 15" long by 4" wide for a small unit, 23" long by 6" wide for a medium sized unit, and 46" long and 10" wide for a large unit. While the shape as illustrated provides for corner fitting into waterbed enclosures at one end this is a matter of choice where other applications are involved. The two hinged or foldable segments are of sufficient length to permit the upper segment having the lip over which the sheet corner is draped to overlap the slot through which the sheet corner is threaded so that when the segments are closed, the corner of the sheet is effectively clamped therebetween.

For other uses such as for tent or tarpaulin corners the device may be anchored in other ways instead of by clamping between mattresses, enclosures or furniture cushions.

I claim:

1. In combination with a sheet material which overlies a base member such as a mattress, a retainer for said sheet material which comprises an anchoring member in the form of an elongated flat panel which is at least semi-rigid and which is foldable along a transverse intermediate hinge line formed therein to provide a pair of superimposed segments, the first of said segments having a slot formed therethrough adjacent to the end thereof which is opposite to said hinge line, the second of said segments having a length sufficient to overlap said slot when folded thereover, said slot providing an opening through which a portion of said sheet material is inserted and retained between said segments in superimposed folded position, said segments in said superimposed folded position with said sheet material portion retained therebetween being adapted for insertion beneath said base member to ensure anchoring of said sheet material.

2. A retainer for sheet materials according to claim 1 wherein said sheet materials are formed with one or more corners in which said a corner is drawn through the slot in the first segment and anchored between said segments.

3. A retainer for sheet materials according to claim 2 wherein the sheet material is a bed sheet and the corner is draped over the end of the second segment in folded position and clamped therebetween beneath a bed mattress.

4. A retainer for sheet materials according to claim 3 wherein the corner of said bed sheet is a fitted corner which is drawn through said slot and draped over the end of said second segment in folded position.

5. A retainer for sheet materials according to claim 3 wherein the bed sheet corner extends through said slot and is formed into a knot which is positioned between said segments, said knot forming a canopy which is draped over the end of said second segment.

6. A retainer for bed covers for waterbed mattresses wherein said mattresses are retained within a rectangular enclosure, which comprises an elongated flat panel member which is foldable along a transverse intermediate hinge line formed therein to provide a pair of superimposed segments, the first of said segments having a slot formed near the end thereof opposite the hinge line, the other of said panel members having a contoured end portion, said slot providing means for threading therethrough of the corner of said bed cover and said panel member having a length sufficient to overlap said slot when said segments are folded over each other, said bed cover engaging said contoured end of said second segment and being clamped between said segments for positioning beneath said mattress, said first segment having angular sides at the end adjacent to said slot thereof for engagement with the corner of the said waterbed enclosure.

7. A method for fitting the corner of a bed sheet over a mattress which comprises providing an elongated at least semi-rigid flat member having a hinge formed transversely thereof to provide a pair of members foldable over each other one of said members having a slot formed therein adjacent to the end thereof opposite said hinge, the other of said members overlapping said slot, placing a bed sheet over said mattress without inserting the corners thereunder, positioning said flat member over the sheet at the corner of said mattress with said segments folded over in alignment from the corner to the center of the bed, threading a corner of the sheet through said slot from underneath into position between said segments, lifting the corner of the mattress while compressing the said corner of the sheet between said segments, then positioning said compressed segments with said corner positioned therebetween beneath said mattress corner and lowering said mattress to retain said segments with the corner of said sheet compressed therebetween beneath said mattress corner.

8. A method according to claim 7 wherein the sheet is of the fitted type with a pocket formed at the corner and wherein said pocket is fitted over the end of said slotted segment after said corner is threaded through said slot.

9. A method according to claim 7 wherein the sheet is of the non-fitted type and wherein a knot is formed in the corner thereof after it is threaded through said slot, said knot farming a pocket which is compressed between said segments prior to positioning beneath said mattress.

* * * * *